US005915782A

United States Patent [19]

Geldbaugh

[11] Patent Number: 5,915,782

[45] **Date of Patent: *Jun. 29, 1999**

[54] COLLAPSIBLE CHAIR

[76] Inventor: G. Richard Geldbaugh, 2600 Pualani Way, #2905, Honolulu, Hi. 96815

[ * ] Notice: This patent is subject to a terminal disclaimer.

[21] Appl. No.: 08/429,478

[22] Filed: Apr. 27, 1995

Related U.S. Application Data

[63] Continuation-in-part of application No. 08/055,843, May 3, 1993, Pat. No. 5,415,455.

[51] Int. Cl.[6] ..... A47C 4/44

[52] U.S. Cl. ..... 297/45; 297/16.2; 297/411.43

[58] Field of Search ..... 297/45, 16.2, 54, 297/44, 16.1, 411.4, 411.42, 411.43

[56] References Cited

U.S. PATENT DOCUMENTS

| | | | |
|---|---|---|---|
| 3,228,724 | 1/1966 | Resar | 297/45 |
| 4,784,436 | 11/1988 | Sutherland | 297/45 X |
| 4,889,383 | 12/1989 | Jones | 297/54 |

FOREIGN PATENT DOCUMENTS

| | | | |
|---|---|---|---|
| 562450 | 9/1923 | France | 297/44 |
| 1245366 | 9/1960 | France | 297/45 |

*Primary Examiner*—Peter M. Cuomo
*Assistant Examiner*—David E. Allred

[57] ABSTRACT

A chair (110) with a fabric sling backrest (143) and seat (153) which are suspended under tension when the chair is expanded from seat support members (151, 152) and back support members (141, 142). The chair (110) collapses by releasing the back stretcher member (144) which swivels parallel to the back support tube (142). The back support members (141, 142) also pivot down adjacent to seat support members 151, 152 with the stretcher tubes (121, 131) released from receiver connectors (123, 133) and rotating ninety degrees to be parallel with the seat support tubes (151, 152). The chair (110) then easily folds into a compact carrying size. The chair fits into a carrying bag, or alternatively, carrying straps are sewn directly onto the fabric sling.

15 Claims, 9 Drawing Sheets

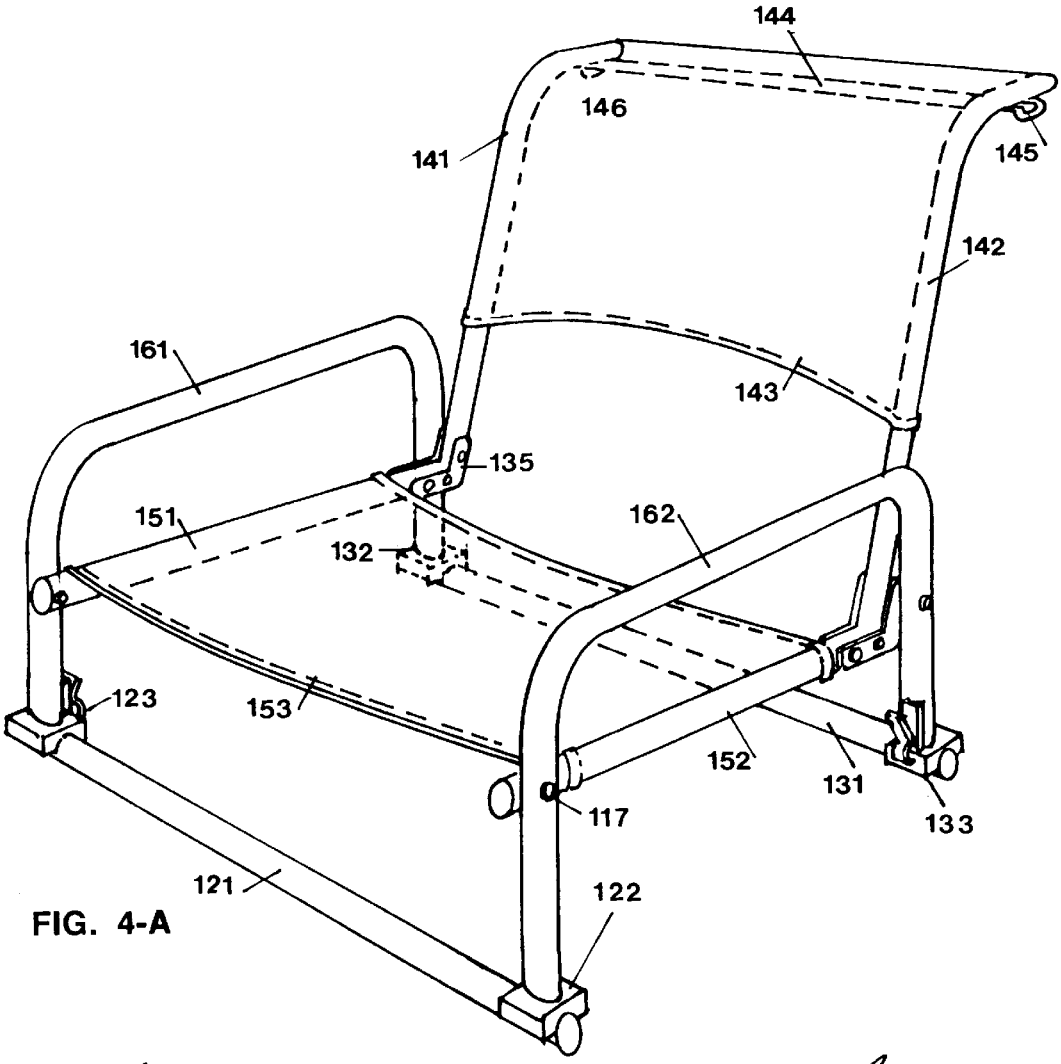
FIG. 4-A
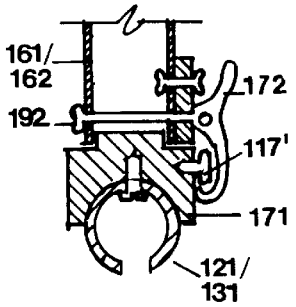
FIG. 4-B
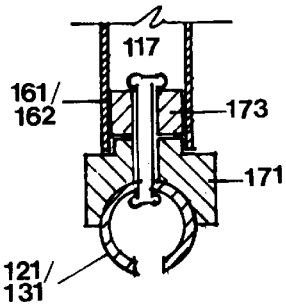
FIG. 4-C

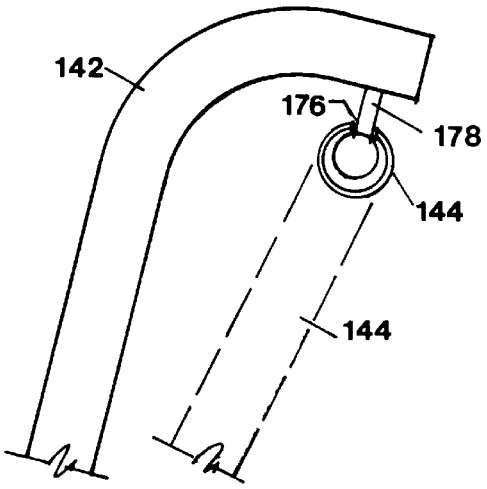
FIG. 5-A
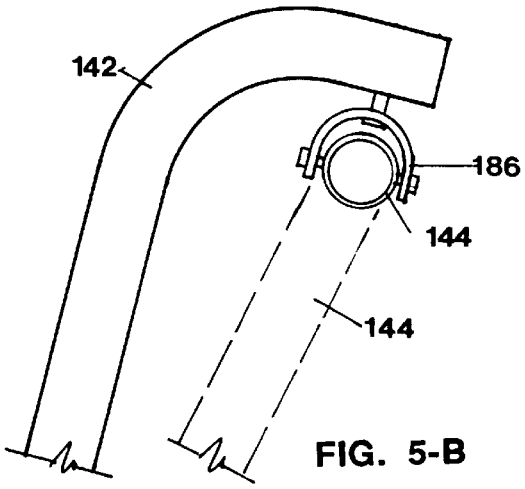
FIG. 5-B
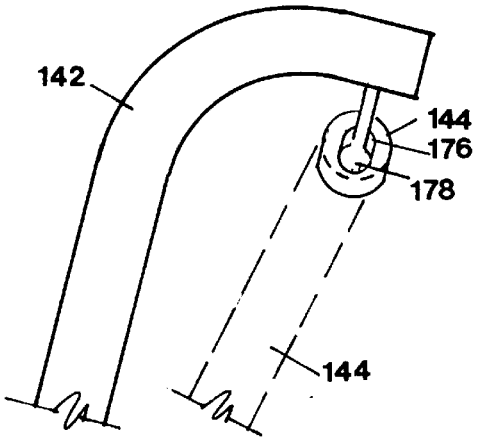
FIG. 5-C
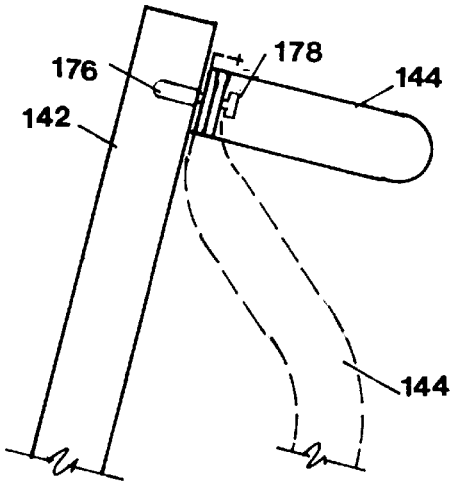
FIG. 5-E
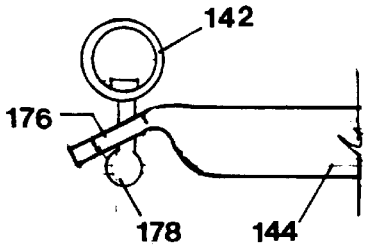
FIG. 5-D
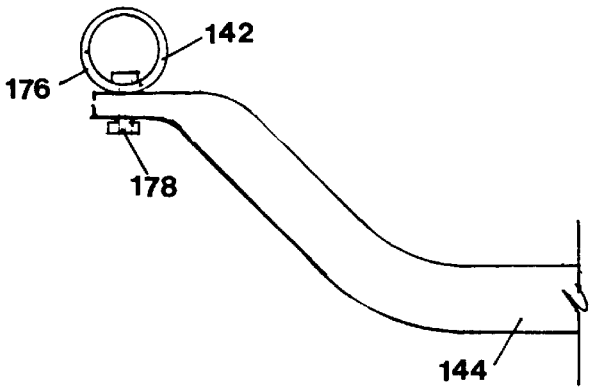
FIG. 5-F

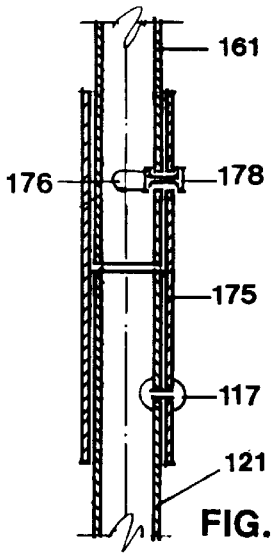
FIG. 6-A
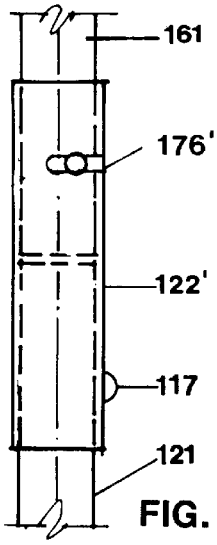
FIG. 6-B
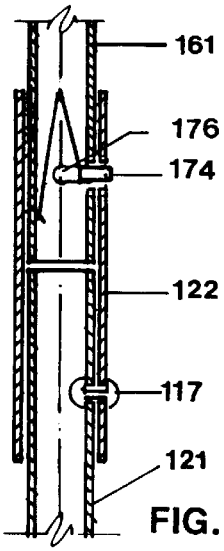
FIG. 6-C
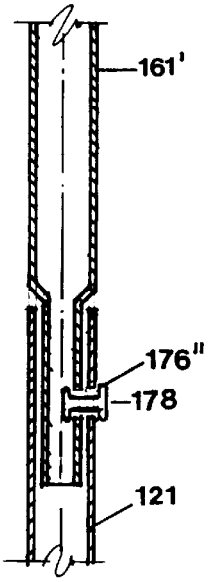
FIG. 6-D
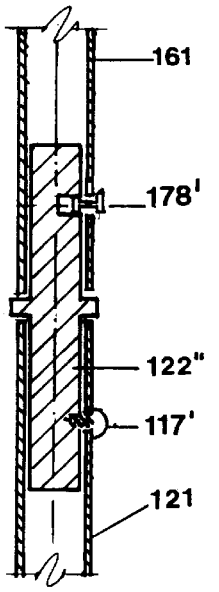
FIG. 6-E
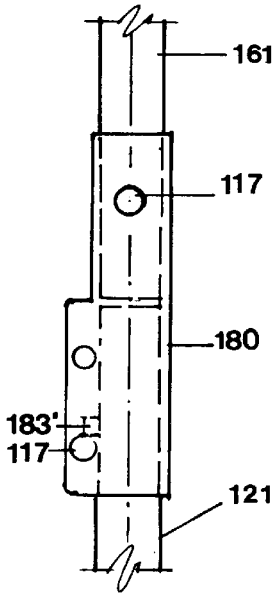
FIG. 6-F

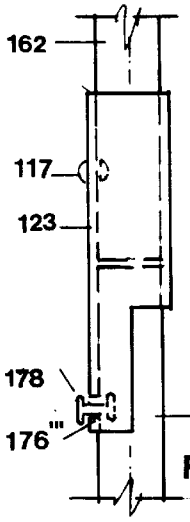
FIG. 7-A
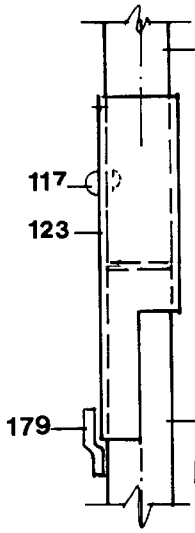
FIG. 7-B
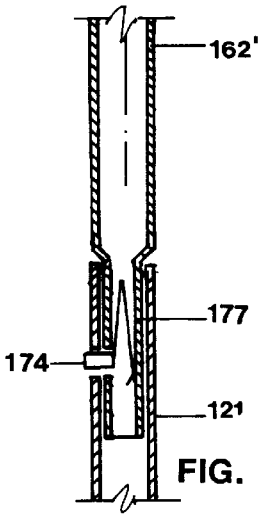
FIG. 7-C
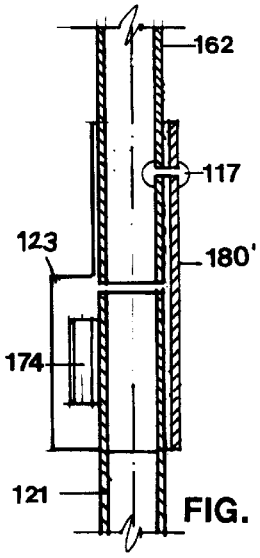
FIG. 7-D
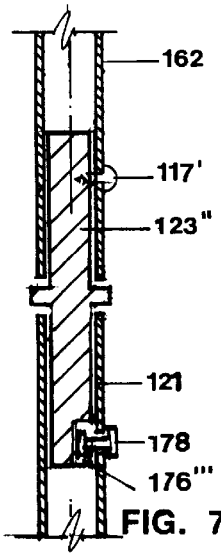
FIG. 7-E
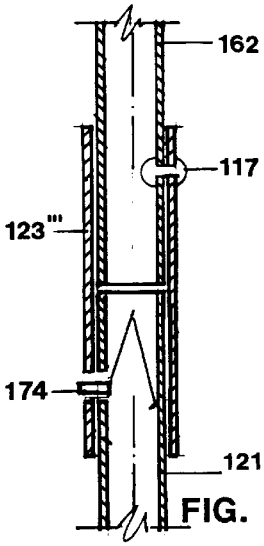
FIG. 7-F
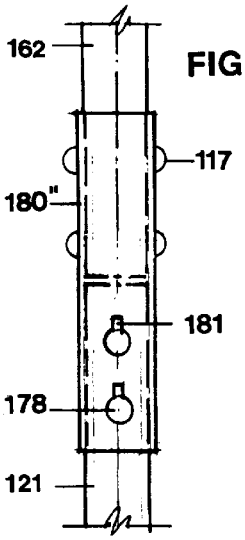
FIG. 7-G

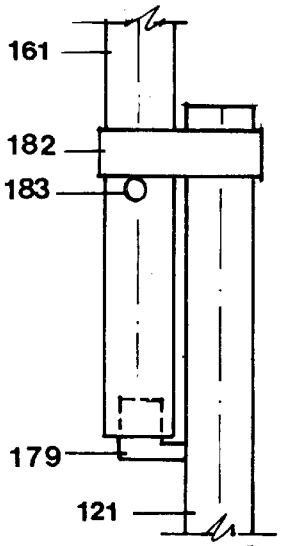
FIG. 8-A
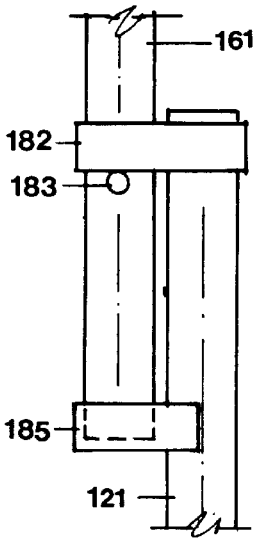
FIG. 8-B
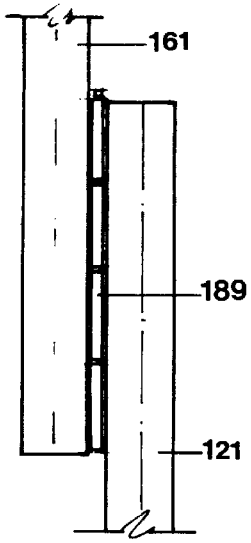
FIG. 8-C
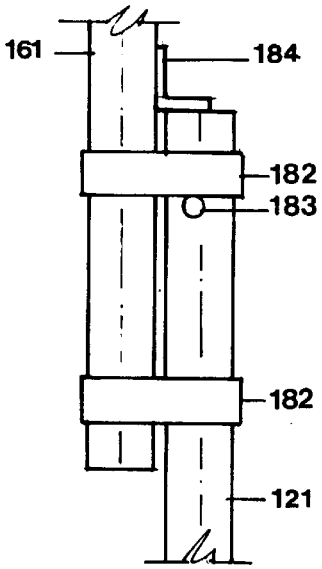
FIG. 8-D

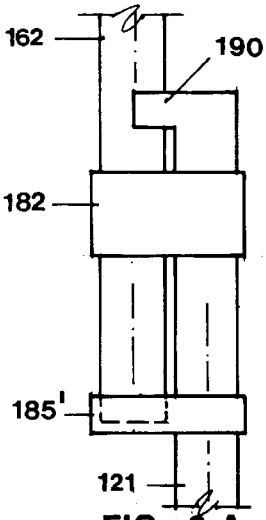
FIG. 9-A
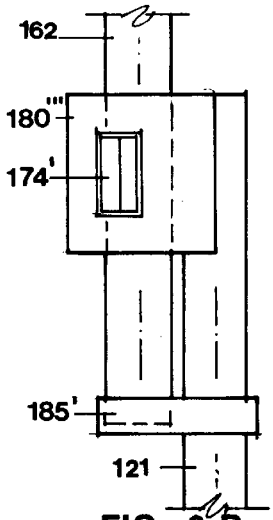
FIG. 9-B
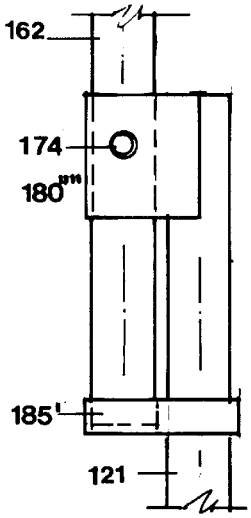
FIG. 9-C
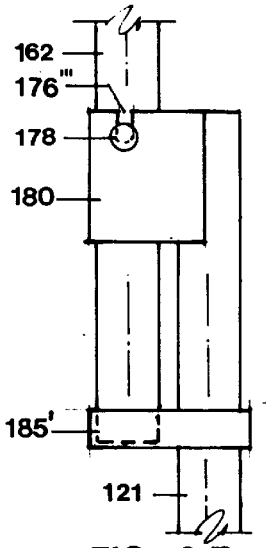
FIG. 9-D
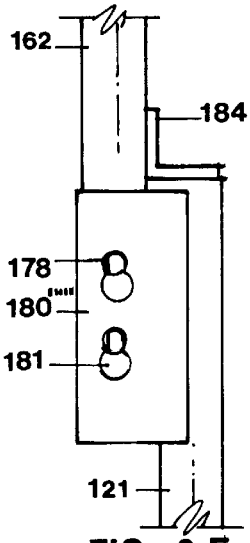
FIG. 9-E
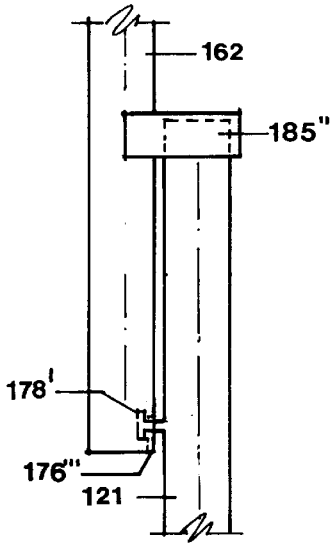
FIG. 9-F
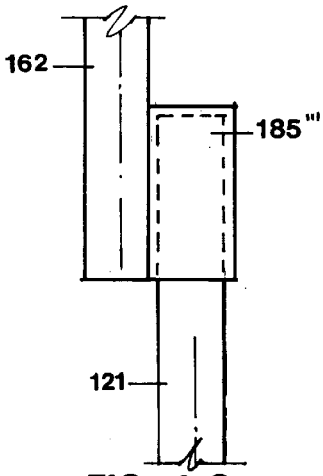
FIG. 9-G
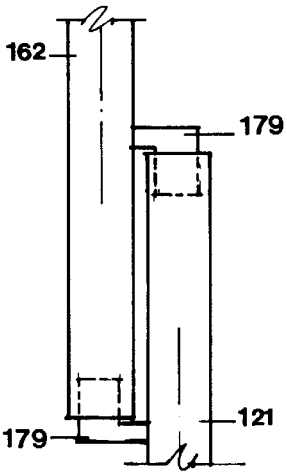
FIG. 9 H

COLLAPSIBLE CHAIR

This is a continuation in part of Ser. No. 08/05,843, filed May 3, 1993.

TECHNICAL FIELD

This invention relates to a collapsible chair which, when folded up, becomes a small convenient package for carrying and can be readily unfolded to a usable chair without requiring assembly of separate parts.

BACKGROUND ART

A large number of collapsible chairs are available for use by the public, but unfortunately these chairs remain awkward to carry and store and often require assembly activities before the chairs can be utilized. A number of U.S. Patents are pertinent to, but do not suggest, the present invention. These are U.S. Pat. Nos. 4,889,383; 4,890,882; 3,285,654; 3,475,050; 3,947,903; 4,577,901; 4,614,377; and 5,058,949. Other relevant references are U.S. Pat. Nos. 4,784,436; French Patent Nos. 1135102; 1161907; 1187222 and 1245366; Canada Patent No. 673237; Italy Patent No. 424573.

DISCLOSURE OF INVENTION

The present invention is for a chair that can be collapsed into a compact volume that is convenient to transport and store. The principal objective of this invention is to provide a chair capable of being easily unfolded for immediate use without requiring assembly of separate components. In preferred embodiments of this invention, the overall volume of the chair is such that it can be easily inserted into a carrying bag, or has carrying straps directly attached to the chair itself for convenient transportation.

The presently preferred embodiment of the collapsible chair of this invention comprises:

an elongated first seat support member, having a front end and a rear end;

an elongated second seat support member, with a front end and a rear end; having approximately the same length;

a sling seat means for receiving and suspending weight with first and second approximately parallel sides attached at the first side to the first seat support member and attached at the second side to the second seat support member (so the sling seat means is suspended between the seat support members when seat support members are positioned approximately parallel to each other and spaced apart by a seat width); with an elongated first arm rest member with a front end and a rear end, having the front end attached to the front end of the first seat support member and rear end attached through brackets to the rear end of the first seat support member;

an elongated second arm rest member with a front end and a rear end having approximately the same length, having the front end attached to the front end of the second seat support member and the rear end attached through brackets to the rear end of the second seat support member;

an elongated front stretcher member with a pivot end and a connector end, permanently pivotably mounted at a pivot end of the front end of the first arm rest member to pivot approximately perpendicular to the first arm rest member (so that the front stretcher member can pivot to be parallel to the first arm rest member and the free connector end can pivot to be adjacent to the front end of the second arm rest member when the arm rest members are positioned approximately parallel to each other and spaced apart by a seat width);

an elongated rear stretcher member, with a pivot end and a connector end, permanently pivotably mounted to a pivot end on the rear end of the second arm rest member at a pivot end on the rear of the second arm rest member (so the rear stretcher member can pivot to be parallel to the second arm rest support member and the free connector end can pivot to be adjacent to the rear end of the first arm rest member when the arm rest members are positioned approximately parallel to each other and spaced apart by a seat width);

a front detachable connector means for detachably connecting the connector end of the front stretcher member to the front end of the second arm support member; a rear detachable connector means for detachably connecting the connector end of the rear stretcher member to the rear end of the first arm rest member (so that connecting the connector end of the stretcher member to the front end of the second arm rest member and connecting the connector end of the rear stretcher member to the rear end of the first arm rest member positions the arm rest members approximately a seat width and suspends the sling seat means between the seat support members).

The pivoting of the members to join with the detachable connectors forms a rigid frame for suspending a fabric seat. The rigid frame also can be structured where the pivotal and detachable connectors attach directly to the seat support members and the frame supports the fabric seat without the arm rest members.

Other objectives and advantages of this invention will herein become obvious from the following detailed description of a preferred embodiment of this invention.

BRIEF DESCRIPTION OF DRAWINGS

FIG. 4-A shows a perspective drawing illustrating an alternative preferred embodiment of the chair with straight stretcher members.

FIG. 4-B shows a section of drawing of detachable connector with leg portion ninety degrees to stretcher member.

FIG. 4-C shows a sectional drawing of pivotal connector with leg portion ninety, degrees to stretcher member.

FIGS. 5, A–F show end and top views of back rest stretcher member connector configurations.

FIGS. 6, A–F show side views and cross sectional drawings of aligned axis pivotable connector configurations.

FIGS. 7, A–G show side views and cross sectional drawings of aligned axis detachable connector configurations.

FIGS. 8, A–D show side view drawings of parallel axis pivot connector configurations.

FIG. 9, A–H show side view drawings of parallel axis detachable connector configurations.

DESCRIPTION OF FIGURES

Figure 1:
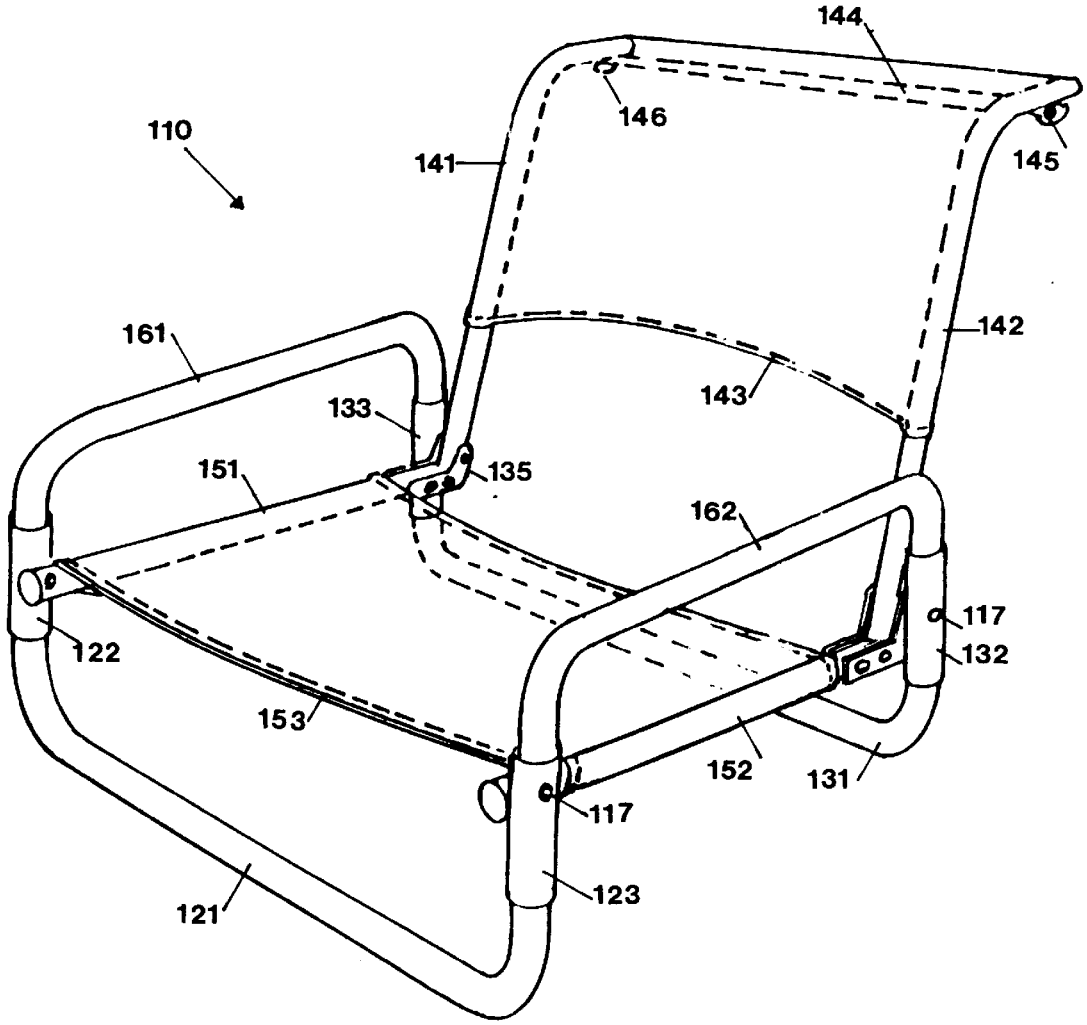
FIG. 1 shows a perspective drawing illustrating the chair in the expanded position for use.

FIG. 1 shows the chair 110 in it's expanded form wherein a front stretcher member 121 is pivoted about a pivotable connector 122 attached to an arm rest support member 161 with the free end of a stretcher member 121 joining to a detachable connector 123 attached to an arm rest member 162.

A rear stretcher member 131 is pivoted about a pivotable connector 132 attached to an arm rest member 162 with the free end of a stretcher member 131 joining a detachable connector member 133 attached to an arm rest member 161.

To the front of arm rest members 161, 162, seat support members 151,152 are attached thru pivotal connector 122 and detachable connector 123, by mechanical fasteners 117. The rear portion of seat support members 151, 152 are attached to a pair of "L" shaped brackets 135 which are attached by mechanical fasteners 117 thru the upper portion of brackets 135 and thru rear detachable connector 133 and rear pivotal connector 132.

Between the seat support members 151,152 a fabric sling seat 153 is suspended. Back support members 141, 142 are pivotally attached between the upper portion of "L" shape brackets 135 by mechanical fastener means 117 connecting brackets 135 to arm rest members 161,162.

The back support members 141, 142 are pivoted about "L" shaped brackets 135 to an upward position. Between back support members 141, 142 a fabric sling back 143 is suspended.

A back rest stretcher member 144 is attached by a pivotable connector 145 to back support tube 142. The free end of back stretcher member 144 is joined to a detachable connector 146 attached to back support member 141.

Figure 2:
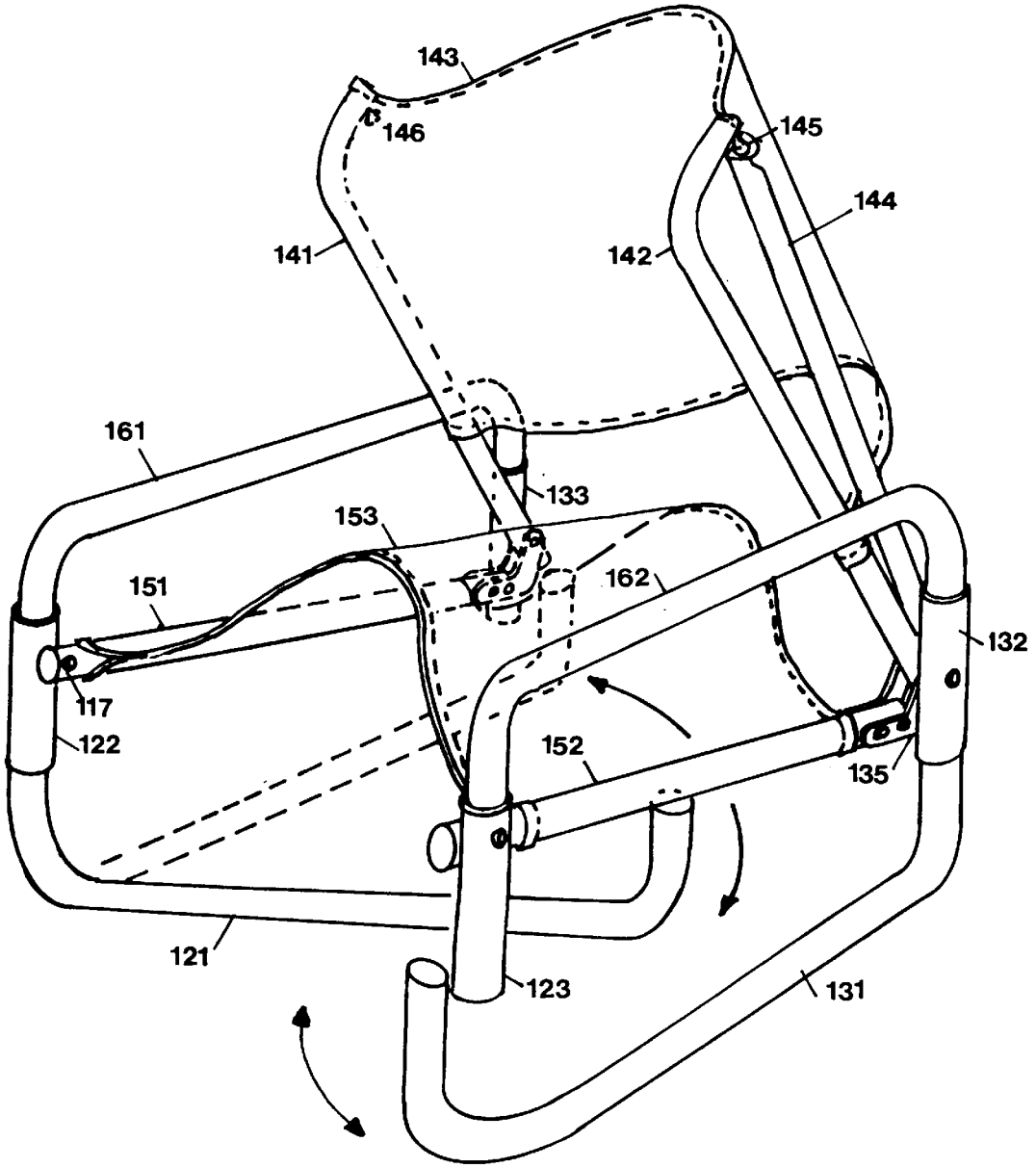
FIG. 2 shows a perspective drawing illustrating the chair collapsing to its compact shape, or conversely expanding for use.

FIG. 2 shows the chair in the folding or expanding phase. For the folding process back rest stretcher member 144 is released from detachable connector 146 and the member pivots about pivotable connector 145 to a position parallel to back support member 142.

Backrest support members 141, 142 pivot downward about the pivot means in the upper portion of "L" shaped brackets 135 to a position parallel to seat support members 151,152.

Rear stretcher member's 131 free end is released from detachable connector 133 and pivots about pivotable connector 132 to a position parallel to arm rest member 162.

Front stretcher member's 121 free end is released from detachable connector 123 and pivots about pivotable connector 122 to a position parallel to arm rest member 161.

After the members are pivoted into position, the two sides of the chair are stacked together and fabric sling seat 153 and back rest sling support 143 are wrapped around the members.

The process of expanding the chair reverses the procedure.

Figure 3:
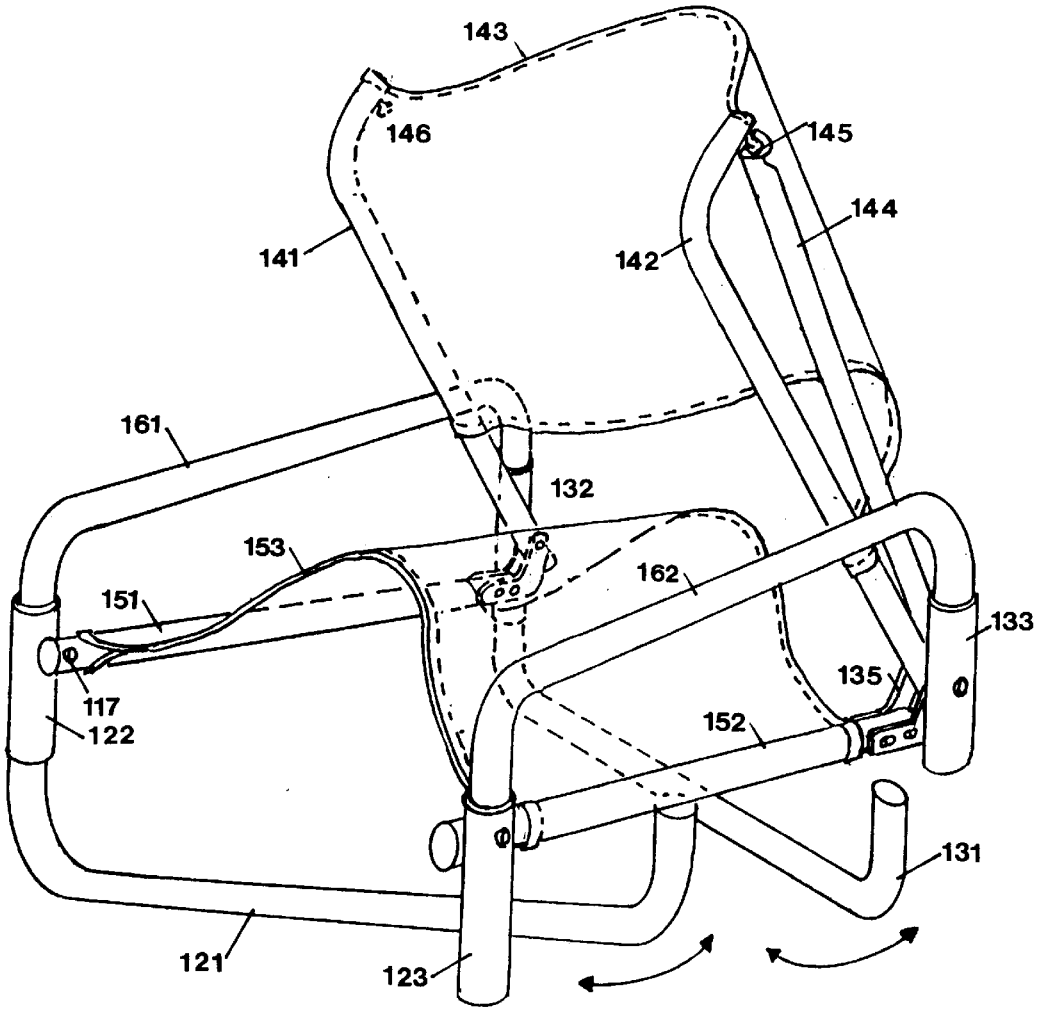
FIG. 3 shows a perspective drawing illustrating an alternative preferred embodiment of the chair collapsing to its compact configuration, or conversely expanding for use.

FIG. 3 shows the chair in the folding or expanding phase, wherein a connector arm rest member 163 has pivotable connector 122 on the front end and pivotable connector 132 attached to the rear end of the member.

A receiver arm rest member 164 has detachable connector 123 on the front and detachable connector 133 attached to the rear of the member.

In the folded position both front and rear stretcher members 121,131 are positioned substantially parallel to connector arm rest member 163.

Other components of the structure and the folding or expanding process is similar as described in FIG. 2.

FIG. 4-A shows the chair in it's expanded form wherein front and rear stretcher members 121 and 131 are straight in configuration and the vertical leg portions of arm rest members 161 and 162 are extended in length. Pivotal connectors 122, 132 and detachable connectors 123, 133 abut the stretcher member's 121, 131 longitudinal axis at a ninety degree relationship.

Other components of the chair structure are as described in FIG. 1.

FIG. 4-B shows detachable connector 123 with the axis of the leg portion of arm rest members 161, 162 being at ninety degrees to the longitudinal axis of stretcher members 121, 131.

To the top of stretcher members 121, 131, bearing block means 171 with a raised circular area, is attached by mechanical fastener means 118. To the side of bearing block means 171 a fastening stud means 178 is mounted.

To the side of the leg portion of arm rest members 161, 162 a cam fastener means 172 is attached by mechanical fasteners 117.

Cam fastener means 172 on the leg portion interlocks with stud connector means 178 on bearing block 171.

FIG. 4-C shows pivotable connectors 122, 132 with the axis of the leg portion of arm rest members 161, 162 being at ninety degrees to the longitudinal axis of stretcher members 121, 131.

Mounted to the top of stretcher members 121, 131 is bearing block means 171, with raised circular area on it's upper surface.

The leg portion of arm rest members 161, 162 has an insert 173 placed in the end of the leg, and is mounted over the raised circular area of bearing block 171 and mechanical fastener means 117 pivotally joins the parts.

FIGS. 5-A thru 5-F illustrate a variety of pivotable connector means in which back rest stretcher member 144 can pivot from a position perpendicular to back support member 142 to a position parallel to back support member 142.

FIG. 5-A shows an end view of back rest stretcher member 144 wherein the stretcher member is attached by stud connector 178 to back rest support member 142. Backrest stretcher member 144 has an elongated slot 176 in it's pivotable end through which stud connector 178 is inserted. The end of stud connector 178 is capped with a spherical profile about which back rest stretcher member 144 pivots. The pivoting action allows for back rest stretcher member 144 to rotate from a position perpendicular to backrest support member 142, to a position parallel to back rest support 142. The pivoting action further allows for the free end of stretcher member's free end 144 to abut back rest support tube 142.

FIG. 5-B shows an end view of back rest stretcher member 144 wherein the pivotable end of stretcher member 144 is attached by a universal joint connector 186 to back rest support member 142. The pivoting action allows for back rest stretcher member 144 to rotate from a position perpendicular to back rest support member 142, to a position parallel to back rest support member 142. The pivoting action further allows for the free end of back rest stretcher member's free end 144 to abut back rest support member 142.

FIGS. 5-C and 5-D show an end view and a top view of back rest stretcher member 144, wherein the stretcher member is attached by stud connector 178 to back rest support member 142. The ends of back rest stretcher member 144 are flattened into a rectangular-shape which is bent at an acute angle to the longitudinal axis of the member. An elongated slot 176 is cut into the angle portion of the rectangular section. Stud connector 178 is inserted through slot 176 and is capped. Back rest stretcher member 144 pivots about stud connector 178. The pivoting action allows for back rest stretcher member 144 to rotate from a position perpendicular to backrest support member 142, to a position parallel to back rest support member 142. The pivoting action further allows for the free end of stretcher member's free end 144 to abut back rest support member 142.

FIGS. 5-E and 5-F show end and top views of back rest stretcher member 144 wherein stretcher member 144 is bent into a splayed "U"-shaped configuration and the ends of stretcher member 144 are flattened into a rectangular profile. The flattened portions project outward from the member profile. Into back support member 142 an elongated slot 176 is placed. Stud connector 178 is inserted thru the slot and attached to back rest support member 142, allowing back rest stretcher member 144 to rotate around back support member 142. The pivoting action allows for back rest stretcher member 144 to rotate from a position perpendicular to back rest support 142, to a position parallel to back rest support 142.

FIGS. 6-A thru 6-F show a variety of pivotable connector means which have their longitudinal axis in alignment with the elongated axis of the connecting members.

FIG. 6-A shows a cross section of pivotable connector means 122 surrounding two adjoining members. An elongated horizontal slot 176 is cut into member 161 around which the pivoting action occurs. The length of slot 176 determines the amount of rotation of the pivoting action and act as rotation stop means. Through a hole in pivotable connector 122 and into slot 176, fastener means 117, such as a pop rivet, would be inserted and expanded. Connector 122 rotates around slotted member 161. Stretcher member 121 is permanently attached to pivotal connector means 122.

FIG. 6-B shows a side view of pivotable connector means 122' surrounding two adjoining members. An elongated horizontal slot 176' is cut into connector 122' in which the pivoting action occurs. The length of slot 176' determines the amount of rotation of the pivoting action and acts as rotational stop. Through slot 176' in connector 122' and into a hole in member 161, stud fastener means 117, such as a stud pop rivet, would be inserted and expanded. Connector 122' rotates around stud fastener 117. Stretcher member 121 is permanently attached to connector 122'.

FIG. 6-C shows a cross section of pivotable connector means wherein a connector 122 surrounds two adjoining members. Elongated horizontal slot 176 is cut into member 161 around which the pivoting action occurs. The length of slot 176 determines the amount of rotation of the pivoting action and provides stop means. Through a hole in connector 122 and through slot 176, a fastener means, such as spring detent 174, would be inserted and expanded. Sleeve 175 rotates around slotted member 161. Stretcher member 121 is permanently attached to connector 122 by mechanical fastener means 117.

FIG. 6-D shows a cross section of two adjoining members, wherein member 161 is reduced in diameter at its mating end to insert into member 121. Elongated slot 176" is cut into member 121 and the length of slot 176" determines the amount of rotation of the pivoting action. Through elongated slot 176" and into a hole in member 161, fastening means 178, such as a pop rivet, would be inserted and expanded. Member 161 rotates within member 121.

FIG. 6-E shows a cross section of two adjoining members wherein an insert connector 122" extends into the end of first adjoining member 161 and the end of second member 121 joins the members together. Insert 122" portion that is in first member 161 has an elongated slot 176. The length of slot 176 determines the amount of rotation of the pivoting action. Through a hole in first member 161 and into elongated slot 176 an insert connector 122", mechanical fastener 117', such as a pop rivet, is inserted and expanded. First adjoining member 161 rotates around insert connector 122". Second adjoining member 121 is permanently attached to the insert.

FIG. 6-F shows a cross section of two adjoining members where "U" shaped bracket 180 is placed around the members. The legs of bracket 180 are longer for the portion placed around second adjoining member 121. Through the leg portions, mechanical fastener 117, attaches the bracket legs together about second member 121. Stud connector 183' is attached to second member 121 above mechanical fasteners 117. Second member 121 rotates within the bracket. A portion of "U" shaped bracket 180 is placed around first member 161 and is securely attached.

FIGS. 7-A thru 7-G show a variety of detachable connector means which have their longitudinal axis in alignment with the elongated axis or the connecting members.

FIG. 7-A shows a side view of a detachable connector means 123 surrounding two adjoining members. First adjoining member 162 is securely attached to connector 123. Connector 123 is cut away so only a portion completely surrounds the end of second adjoining member 121. Elongated vertical slot 176'" is cut in the end of connector 123. Stud connector means 178 is attached to second member 121 and interlocks with elongated slot 176'" also forming rotation stop means.

FIG. 7-B shows a side view of a detachable connector means 123 surrounding two adjoining members. First adjoining member 162 is securely attached to connector 123. Connector 123 is cut away so only a portion completely surrounds the end of second adjoining member 121. Bracket connector means 179 is attached to second member 121 and interlocks over the end of connector 123.

FIG. 7-C shows a cross section of a detachable connector means wherein first adjoining member 162' has a reduced diameter end that inserts into the end of second adjoining member 121. Through a hole that is aligned through first and second members 162', 121, spring detent 174 locking means is attached. Second member 121 is held into position by spring detent 174 locking means.

FIG. 7-D shows a cross section of a detachable connector means wherein "U"-shaped bracket 180' surrounds two adjoining members. First adjoining member 162 is securely attached to "U"-shaped bracket 180'. "U"-shaped bracket 180' surrounds second adjoining member 121 and has elongated leg portions in which at least one spring detent 174 locking means is inserted. Second member 121 is held into position by spring detent 174 locking means.

FIG. 7-E shows a cross section of two adjoining members that are connected by connector 123" placed into the ends of the members. First adjoining member 162 is securely attached to connector 123". Through a hole in second member 121 and into vertical elongated slot 176"" in connector 123", stud connector means 178, similar to a pop rivet, is inserted and expanded. The stud in the slot provides rotation stop means.

FIG. 7-F shows a cross section of a detachable connector means surrounding two adjoining members. First adjoining member 162 is securely attached to connector 123'". Through an aligned hole in connector 123'" and second adjoining member 121, spring detent 174 locking means is inserted. Second member 121 is held into position by spring detent 174 locking means and provides rotation stop means.

FIG. 7-G shows a side view of a detachable connector means wherein "U"-shaped bracket 180" surrounds two adjoining members. First adjoining member 162 is securely attached to "U"-shaped bracket 180". Attached to second adjoining member 121, are stud connector means 178 which interface with receiver slots 181 provided in "U"-shaped bracket 180". Second member 121 is held into position by stud connector locking means.

FIGS. 8-A thru 8-D show numerous pivotable connectors means in which the connectors join parallel axis members.

FIG. 8-A shows side view of pivotable connector wherein two members are parallel to each other along their longitudinal axis. From second adjoining member 121, surrounding bracket 182 is attached and surrounds first adjoining member 161 allowing it to rotate. Also from second member 121, "L"-shaped bracket 179 protrudes ninety degrees from the longitudinal axis and inserts into the end of first member 161. Stop means 183 protrudes from first member 161 adjacent to surrounding bracket 182 and between the previously described brackets. Second member 121 rotates adjacent to the axis of first member 161.

FIG. 8-B shows side view of pivotable connector wherein two members are parallel to each other along their longitudinal axis. From second adjoining member 121, bracket 182 is attached that surrounds first adjoining member 161 allowing it to rotate. Also from second member 121, end cap bracket 185 protrudes ninety degrees from the longitudinal axis and surrounds the end of first member 161. Stop means 183 protrudes from first member 161 adjacent to surrounding bracket 182 and between the previously described brackets. Second member 121 rotates adjacent to the axis of first member 161.

FIG. 8-C shows a side view of a pivotable connector means wherein the members are parallel to their longitudinal axis. Between and attached to each of the members is a hinge means 189 which allows second adjoining member 121 to rotate in relation to the axis of first member 121.

FIG. 8-D shows side view of pivotable connector wherein two members are parallel to each other along their longitudinal axis. From first adjoining member 161 two surrounding brackets 182 are attached and surround second member 121 allowing it to rotate. Stop means 183 protrudes from second adjoining member 121 adjacent to upper surrounding bracket 182 and between the two brackets. Also from first member 161, "L"-shaped bracket 179 protrudes forming a stop against which second member 121 abuts. Second member 121 rotates within surrounding brackets 182 and is held in position by stop means 183.

FIGS. 9-A thru 9-H show numerous detachable connector means in which the connectors join parallel axis members.

FIG. 9-A shows a side view of a detachable connector wherein the two members are parallel to one another along their longitudinal axis. From second adjoining member 188, positioning bracket 190 protrudes that surrounds half of first adjoining member 162. Also from second member 121, bracket 185' protrudes that surrounds the end of first member 162. Attached to second member 121 is surrounding bracket 182 which detachably connects the two members.

FIG. 9-B shows a side view of a detachable connector wherein the two members are parallel to one another along their longitudinal axis. From second adjoining member 121, "U"-shaped bracket 180'" protrudes, surrounding the sides of first member 162. Into "U"-shaped bracket 180'", spring detent means 174 is inserted, allowing the member 162 to be inserted into position and held in place. Also from second member 121, end cap bracket 185 protrudes that surrounds the end of first member 162.

FIG. 9-C shows a side view of a detachable connector wherein the two members are parallel to one another along their longitudinal axis. From second adjoining member 121, "U"-shaped bracket 180"" protrudes, surrounding the sides of first adjoining member 162. In "U"-shaped bracket 180"", a circular opening is provided. First member 162 is inserted into "U"-shaped bracket 180"" and spring detent means 174 within the member protrudes through a hole in the member and engages with the circular opening in bracket 180"", thereby holding the member in position. Also from second member 121, end cap bracket 185' protrudes that surrounds the end of first member 162.

FIG. 9-D shows a side view of a detachable connector wherein the two members are parallel to one another along their longitudinal axis. From second adjoining member 121, "U"-shaped bracket 180 protrudes surrounding the sides of first adjoining member 162. In "U"-shaped bracket 180, an elongated vertical slot 176'" is provided. To first member 162, connector stud 178 is attached. When first member 162 is inserted into "U"-shaped bracket 180, stud connector means 178 interlocks with elongated slot 176"". From second member 121, end cap bracket 185' protrudes and surrounds the end of first member 162.

FIG. 9-E shows a side view of a detachable connector wherein the two members are parallel to one another along their longitudinal axis. From second adjoining member 121, bracket 180"" protrudes surrounding the sides of first adjoining member 162. In bracket 180"", slotted receiver slots 181 are provided. To first member 162, connector studs 178 are attached. When first member 162 is inserted into bracket 180"", stud connector means 178, interlocks with slotted receiver slots 181.

FIG. 9-F shows a side view of a detachable connector wherein the two members are parallel to one another along their longitudinal axis. To second adjoining member 121, stud connector means 178' is attached and interfaces with an elongated vertical slot 176'" that is provided in the end of first adjoining member 162. From first member 162, end cap bracket 185" protrudes and surrounds the end of second member 121.

FIG. 9-G shows a side view of a detachable connector wherein the two members are parallel to one another along their longitudinal axis. To first member 162, end capped bracket 185'" is attached and into end capped bracket 185'", second member 121 is inserted thereby held into position.

FIG. 9-H shows a side view of a detachable connector wherein the two members are parallel to one another along their longitudinal axis. To first member 162, "L" shaped bracket 179 is attached. To second member 121, "L" shaped bracket 179 is also attached. Bracket 179 attached to first member 162, inserts into the end of second member 121. Conversely, bracket 179 is attached to second member 121 and inserts into the end of first member 162.

BEST MODE FOR CARRYING OUT INVENTION

FIG. 1 shows the present preferred embodiment of the chair in it's usable expanded configuration with a front leg and stretcher member 121 pivotably attached at a pivot end to front leg pivoting connector 122 and rear leg and stretcher member 131 pivotably attached at a pivot end to rear pivoting connector 132 for pivoting approximately perpendicular to arm rest members 161 and 162 to which the stop means limits the amount of rotation to approximately ninety degrees. Leg and stretcher members 121, 131 comprise an elongated stretcher portion with two leg portions that function as legs attached to either side of the stretcher portion. Free connector ends of front leg and stretcher member 121 and rear leg and stretcher member 131 are locked into position opposite front leg detachable connector 123 and opposite rear left detachable connector 133 forming a rigid connection. Front leg pivoting connector 122 is rigidly attached to arm rest member 161 by securement means 117 and rear pivoting connectors 132 are attached to arm rest member 162 by securement means 117.

To the front of arm rest member 161, seat support member 151 is attached by mechanical means, 117. Similarly, to the front of arm rest support member 162, seat support member 152 is attached.

To the rear of seat support members 151, 152 "L" shaped brackets 135, are attached by mechanical means 117. Seat support members 151, 152 provide support for fabric sling seat 153 which wraps around seat support members 151, 152 and is preferably sewn to itself.

In the upper portion of "L" shaped brackets 135, mechanical fastener means 117 joins brackets to arm rest support members 161, 162. Mechanical fastener means 117 passes through the pair of "L" shaped brackets 135 and through back rest support members 141, 142 thus providing for a pivotable connection. The ends of back rest support members 141, 142 abut the ends of seat support members 151, 152 providing a stop for the pivoting action. Back support members 141, 142 pivot upward providing support for fabric sling back rest 143 which wraps around back support members 141, 142 and is preferably sewn to itself. An elongated back rest stretcher member 144 having a pivot end and a free end, is attached by pivot connector 145 to back support member 142 and spaces the upright back rest support members 141, 142 a seat width apart and is attached by detachable connector means 146 to back support member 141. With the chair expanded, fabric sling seat 153 and fabric sling back rest 143 are suspended to receive weight.

In expanding the preferred embodiment of the chair (as shown in FIG. 2), front leg and stretcher member 121 and rear leg and stretcher member 131 swivel within leg pivoting connectors 122, 132. As leg and stretcher members 121, 131 swivel ninety degrees in relationship to arm rest members 161 and 162 to which they are attached, they join to detachable connectors 123, 133 on the opposite sides of the chair. Diagonal racking action or wobbling of the chair is controlled by rotation limiting stop means 116. Leg connectors 122, 123, 132, 133 are thus firmly attached to arm rest members 161, 162 forming a rigid frame. From seat support members 151, 152 attached to arm rest support members 161, 162, sling seat 153 is suspended. From this expanded frame configuration, back support members 141,142 are pivoted upward to a substantially vertical position. Back rest stretcher member 144 is mounted to back support member 142 and is pivoted about pivotal connector means 145 to a lateral position and the member's free end is joined to detachable connector 146 on opposite back support member 141 providing a structural frame from which back rest fabric sling 143 is suspended.

In collapsing the chair (as shown in FIG. 2), back support stretcher member 144 is detached from detachable connector means 146 and pivots ninety degrees around stretcher member pivot means 145 to be parallel with back support member 142. Back support members 141 and 142 pivot about a pivot connector on the upper portion of leg brackets 135 to be parallel and adjacent to seat support members 151, 152. Front leg stretcher member 121 is then released from front leg detachable connector 123 and swivels in a rearward direction ninety degrees until it is parallel with and adjacent to (under) arm rest member 161 to which it is attached. Rear leg and stretcher member 131 is then released from rear detachable connector 133 and swivels in a foreword direction ninety degrees until it is parallel with and adjacent (under) arm rest member 162 to which it is attached.

With the support and stretcher members thus aligned, adjacent and parallel, the opposite side structural members are placed side by side and fabric sling back rest 143 and fabric sling seat 153 are wrapped around the members. Thus, the chair collapses into a compact configuration. For ease in carrying the collapsed chair, optional carrying straps could be incorporated in the design of the fabric sling back rest.

Alternatively, the compact assembly could easily slip into a carrying bag for ease in handling.

FIG. 3 illustrates, in a perspective view, an alternative preferred embodiment of the chair of this invention in it's expanding form wherein both front and back leg stretcher members 121, 131 swivel from front and rear ends of first arm rest support member 161. First arm rest support member 161 has front pivoting connector 122 attached at it's front end and rear pivoting connector 132 attached at it's rear end.

From front pivoting connector 122, front leg and stretcher member 121 is pivotally attached and pivots forward from a position substantially aligned under first arm rest member 161.

From rear pivoting connector 132, rear leg and stretcher member 131 is pivotally attached and pivots rearward from a position substantially aligned under first arm rest member 161. Rotation stop means (as shown in FIG. 6-A, 6-E) limits the degree of rotation of the pivoting connectors 122, 132 allowing approximately ninety degree rotation.

Positioned on the opposite side of the chair substantially parallel to first arm rest support member 161 and spaced apart by the length of stretcher members 121, 131, is second arm rest support member 162. Front detachable connector 123 is attached to front and rear detachable connector 133 is attached to the rear of member 162.

The free connector end of front leg and stretcher member 121 is mated with front leg detachable connector 123 and secured to second arm rest support member 162.

The free connector end of rear leg and stretcher member 131 is mated with rear leg detachable connector 133 secured to the rear end of second arm rest support member 162. Seat support member 151 is attached to first arm rest support member 161 and seat support member 152 is attached to second arm rest support member 162. Between seat support members 151, 152, fabric sling seat 153 is suspended by wrapping the fabric around the seat support members and sewing the fabric to itself. Except as specified, the parts correspond to the embodiment described previously in FIG. 1 and have been accordingly similarly labeled. The expanding of the back support is a previous described in FIG. 2.

When folding this alternative embodiment into a compact configuration, back stretcher member 144 is detached from detachable connector means 146 and pivots ninety degrees around stretcher member pivot means 145 to be parallel with back support member 142. Back support members 141, 142 pivot downward to be parallel with seat support members 151, 152. Front leg and stretcher member 121 detaches from front detachable connector 123.

Front leg and stretcher member 121 swivel about pivotal connector 122 rearward to be in substantial alignment with and under arm rest support member 161. Rear leg and stretcher member 131 detaches from rear detachable connector 133.

Rear leg and stretcher member 131 swivels forward to be in substantial alignment with and under arm rest support member 161.

Fabric back rest 143 and fabric sling seat 153 are wrapped around arm rest support members 161, 162, seat support members 151,152, back rest support members 141,142, back stretcher member 144, and front and rear leg stretcher members 121,131. The chair collapses to a dimension easily carried.

Detachable connector's 123,133 function is to receive the free end of front and rear stretcher members 121, 131 and hold the members in position so front and rear stretcher members 121,131 are substantially perpendicular to seat support members 151,152 or arm rest members 161, 162. Detachable connectors 123, 133 easily release front and rear stretcher members 121,131 for the folding process.

This unique function can be accomplished by many detachable connector means in addition to the ways shown in FIGS. 4-B, FIGS. 7 A–G, FIGS. 9 A–H.

Back rest stretcher member 144 provides lateral stability to back rest support members 141,142. The unique function of back rest stretcher member 144 is to pivot from a lateral stabilizing position to a position parallel to the other chair structural members when in the folding position.

This pivoting function is accomplished by many pivotal connector means, examples of which are shown in FIGS. 5 A–F.

Pivotable connector's 122,132 function is to permanently pivotally attach stretcher members 121,131 to seat support members 151,152 or arm rest members 161,162 allowing for the stretcher members to pivot in approximately a ninety degree movement from a position substantially parallel with the seat support member or arm rest member, to a position substantially perpendicular to the seat support member or arm rest member to which it is attached. Pivotable connector's 122, 132 could attach to auxiliary components which are then connected to seat support members 151, 152 or arm rest support members 161, 162.

There are numerous ways to accomplish the pivotal connector means task as shown in FIG. 4 C, FIGS. 6, A–F, FIGS. 8, A–D.

This function is unique and pivotal connector means that can be used to accomplish the task are numerous.

It should now be apparent that the collapsible chair described above, possesses unique attributes as set forth in the summary of the invention. Because the chair can be modified to some degree without departing from the principals as they have been outlined in this specification, this invention should be understood to encompass all such modifications as fall within the scope and spirit of the following claims.

What is claimed is:

1. A collapsible chair that can be expanded for use without assembling separate components, compromising:

an elongated first arm rest support member having an arm rest support length, a front end and a rear end;

an elongated second arm rest support member having a length substantially equal to said arm rest support length, a front end and a rear end;

an elongated first seat support member having a seat support length along a longitudinal axis thereof, a front end and a rear end attached by a securement means to said front and rear ends of said first arm rest support member respectively;

an elongated second seat support member having a length along a longitudinal axis thereof substantially equal to said seat support length, a front end and a rear end attached by securement means to said front and rear ends of said second arm rest support member respectively;

a sling seat means for receiving and suspending weight having first and second substantially parallel sides attached at said first side to said first seat support member and attached at said second side to said second seat support member, whereby said sling seat means is suspended between said seat support members when said seat support members are positioned substantially parallel to each other and spaced apart by a seat width;

an elongated front stretcher member having a pivot end and a connector end defining a stretcher member length, permanently pivotably attached by a first pivotal connector means at said pivot end on said front end of said first arm rest support member to pivot about a front stretcher member axis which is substantially perpendicular to said first arm rest support member, whereby said front stretcher member can pivot to be parallel to said first arm rest support member and whereby said connector end of said front stretcher member can pivot to be adjacent to said front end of said second arm rest support member when said arm rest support members are positioned substantially parallel to each other and spaced apart by substantially said seat width;

an elongated rear stretcher member having a pivot end and a connector end spaced apart by substantially said stretcher member length permanently pivotably attached by a second pivotal connector means at said pivot end on said rear end of said second arm rest support member to pivot about a rear stretcher member axis which is substantially perpendicular to said second seat support member, whereby said rear stretcher member can pivot to be parallel to said second arm rest support member and whereby said connector end of said rear stretcher member can pivot to be adjacent to said rear end of said first arm rest support member when said arm rest support members are positioned substantially parallel to each other and spaced apart by substantially said seat width;

front detachable connector means for detachably connecting said connector end of said front stretcher member to said front end of said second arm rest support member;

rear detachable connector means for detachably connecting said connector end of said rear stretcher member to said rear end of said first arm rest support member;

whereby connecting said connector end of said front stretcher member to said front end of said second arm rest support member and connecting said connector end of said rear stretcher member to said rear end of said first arm rest support member positions said arm rest support members substantially parallel and spaced apart from each other by substantially said seat width.

2. A chair according to claim 1, wherein each of said stretcher members comprises:

a combined leg and stretcher structure comprising a horizontal stretcher portion having said stretcher member length and vertical leg portions attached to opposite ends of said horizontal stretcher portion.

3. A chair according to claim 1, further comprising: an elongated first back support member having a bottom end and top end permanently pivotably mounted at said bottom end to said rear end of said first seat support member to pivot about a first back support axis perpendicular to and the longitudinal axis of said first seat support member with said first back support member having a detachable connector mounted at said top end;

an elongated second back support member having a bottom end and a top end permanently pivotably mounted at said bottom end to said rear end of said second seat support member to pivot about a second back support axis perpendicular to and adjacent to the longitudinal axis of said second seat support member with said second back support member having a pivotal connector mounted at said top end;

an elongated back stretcher member having a support length with a pivot end and a connector end joined at said pivot end by said pivotal connector to said second back support member with said back stretcher member secured to said first back support member by said detachable connector positioning said back support members substantially parallel to each other and spaced apart by said back stretcher member length; and sling backrest means for receiving and suspending weight having first and second substantially parallel sides attached at said first side to said first back support member and attached at said second side to said second back support member, whereby said sling backrest means is suspended between said back support members when said back support members are positioned substantially parallel to each other.

4. A chair according to claim 1, wherein said front detachable connector means further comprised of first locking means for locking said connector end of said front stretcher member to said front end of said second arm rest support member when they are connected; and wherein said rear detachable connector means further comprises said second locking means for locking said connector end of said rear stretcher member to said rear end of said first arm rest support member when they are connected.

5. A chair according to claim 1, wherein said pivotal connector mean's longitudinal axis is in alignment with the longitudinal axis of an end portion of said stretcher member and an end portion of said arm rest support member; wherein said stretcher member pivots about or within said pivot connector means.

6. A chair according to claim 1, wherein said pivotal connector means permanently pivotally joins and positions the longitudinal axis of an end portion of said arm rest support member parallel to the longitudinal axis of an end portion of said stretcher member wherein said stretcher member pivots about or within said pivot connector means.

7. A chair according to claim 1, wherein said detachable connector means longitudinal axis is in alignment with the longitudinal axis of an end portion of said stretcher member and an end portion of said arm rest support member; wherein said members are joined together so they are detachable.

8. A chair according to claim 1, wherein said detachable connector means joins and positions the longitudinal axis of an end portion of said stretcher member parallel to the longitudinal axis of an end portion of said arm rest support member with said members being detachable.

9. A chair according to claim 1, wherein said pivoting connectors have rotation limit means.

10. A chair according to claim 1, wherein said detachable connectors have rotation limit means.

11. A chair according to claim 1, wherein said elongated front and rear stretcher members are straight in configuration and the longitudinal axis of said stretcher members are at an angle of substantially ninety degrees with respect to extended leg portions at the said ends of said arm rest support members and are joined together by said arm rest support members, pivotal connector means, and detachable connector means.

12. A chair according to claim 11, wherein said pivotal connector permanently pivotally joins and positions the longitudinal axis of said extended leg portion of said arm rest support member at ninety degrees to the longitudinal axis of said stretcher member with said stretcher member pivoting about or within said pivotal connector.

13. A chair according to claim 1, wherein said detachable connector joins and positions the longitudinal axis of said extended leg portion of said arm rest support member at an angle of ninety degrees to the longitudinal axis of said stretcher member, wherein said members are joined together so they, are detachable.

14. A collapsible chair that can be expanded for use without assembling separate components, compromising:

an elongated first arm rest support member having an arm rest support length, a front end and a rear end;

an elongated second arm rest support member having a length substantially equal to said arm rest support length, a front end and a rear end;

an elongated first seat support member having a seat support length along longitudinal axis, a front end and a rear end attached by a securement means to the corresponding said front and rear ends of said first arm rest support member;

an elongated second seat support member having a length along longitudinal axis substantially equal to said seat support length, a front end and a rear end attached by securement means to the corresponding said front and rear ends of said second arm rest support member;

a sling seat means for receiving and suspending weight having first and second substantially parallel sides attached at said first side to said first seat support member and attached at said second side to said second seat support member, whereby said sling seat means is suspended between said seat support members when said seat support members are positioned substantially parallel to each other and spaced apart by a seat width;

an elongated front stretcher member having pivot end and a connector end defining a stretcher member length, permanently attached by a first pivotal connector means at said pivot end of said front end of one of said arm rest support members to pivot about a front stretcher member axis substantially perpendicular to arm rest support member to which it is attached, whereby said front stretcher member can pivot to be substantially parallel to said arm rest support member to which it is pivotably attached and whereby said connector end of said front stretcher member can pivot to be adjacent to corresponding end of said arm rest support member on the opposite side of the chair when said arm rest support members are positioned substantially parallel to each other and spaced apart by substantially said seat width;

front detachable connector means for detachably connecting said connector end of said front stretcher member to corresponding said front end of said opposite arm rest support member;

an elongated rear stretcher member having pivot end and a connector end defining a stretcher member length, permanently attached by a second pivotal connector means at said pivot end to one of said rear ends of one of said arm rest support members to pivot about a rear stretcher member axis substantially perpendicular to arm rest support member to which it is attached, whereby said rear stretcher member can pivot to be substantially parallel to said arm rest support member to which it is pivotably attached and whereby;

said connector end of said rear stretcher member can pivot to be adjacent to the corresponding end of said arm rest support member on said opposite side of the chair when said arm rest support members are positioned substantially parallel to each other and spaced apart by substantially said seat width;

rear detachable connector means for detachably connecting said connector end of said rear stretcher member to said rear end of said opposite arm rest support member;

whereby connecting said connector end of said front stretcher member to corresponding said front end of said opposite arm rest support member and connecting said connector end of said rear stretcher member to corresponding said rear end of said opposite arm rest support member positions said arm rest support members substantially parallel and spaced apart from each other by substantially said seat width.

15. A chair according to claim 14, wherein said connector end of said rear stretcher member is pivotably attached by said second pivotal connector means at said rear end to said arm rest support member, to which said front stretcher member is connected, whereby said rear stretcher member can pivot to be substantially parallel to said arm rest support member to which it is attached and whereby said connector end of said rear stretcher can pivot to be adjacent to a corresponding said rear end of said opposite arm rest support member to which it is attached by said rear detachable connector means.

* * * * *